US011643290B2

(12) United States Patent
Morita

(10) Patent No.: US 11,643,290 B2
(45) Date of Patent: May 9, 2023

(54) SHEET FEEDER AND IMAGE FORMING APPARATUS

(71) Applicant: Brother Kogyo Kabushiki Kaisha, Nagoya (JP)

(72) Inventor: Tetsuya Morita, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 203 days.

(21) Appl. No.: 16/997,113

(22) Filed: Aug. 19, 2020

(65) Prior Publication Data

US 2021/0061598 A1 Mar. 4, 2021

(30) Foreign Application Priority Data

Aug. 30, 2019 (JP) ..... JP2019-158615

(51) Int. Cl.

| | |
|---|---|
| ***B65H 7/14*** | (2006.01) |
| ***B65H 7/02*** | (2006.01) |
| ***B65H 3/06*** | (2006.01) |
| ***G03G 15/00*** | (2006.01) |

(52) U.S. Cl.

CPC ..... *B65H 3/0684* (2013.01); *B65H 7/14* (2013.01); *G03G 15/5029* (2013.01); *G03G 15/6529* (2013.01)

(58) Field of Classification Search

CPC ... B65H 7/14; B65H 7/02; B65H 7/04; B65H 2553/612; B65H 2511/51; B65H 3/0684; G03G 15/5029; G03G 15/6529

See application file for complete search history.

(56) References Cited

U.S. PATENT DOCUMENTS

| | | | |
|---|---|---|---|
| 2008/0048138 | A1 | 2/2008 | Miwa |
| 2018/0088513 | A1 | 3/2018 | Wada |

FOREIGN PATENT DOCUMENTS

| | | | | |
|---|---|---|---|---|
| JP | S62-181543 | U | | 11/1987 |
| JP | S62-194645 | U | | 12/1987 |
| JP | H02-233434 | A | | 9/1990 |
| JP | H07-237778 | A | | 9/1995 |
| JP | 09124183 | A | * | 5/1997 |
| JP | H10-109781 | A | | 4/1998 |
| JP | 2008-050109 | A | | 3/2008 |
| JP | 2018-052686 | A | | 4/2018 |

OTHER PUBLICATIONS

Japanese Office Action (with English translation) dated Mar. 7, 2023 (Application No. 2019-158615).

* cited by examiner

*Primary Examiner* — Luis A Gonzalez
(74) *Attorney, Agent, or Firm* — Burr Patent Law, PLLC

(57) ABSTRACT

A sheet feeder includes a sheet tray, a feed roller, a sheet feed frame, a contact element, a guide frame, a photosensor, a shield, and a linkage. The feed roller feeds a sheet on the sheet tray. The sheet feed frame holds the feed roller. The contact element is pivotable relative to the sheet feed frame. The guide frame is disposed below the sheet feed frame. The photosensor includes a light emitter and a light receiver. The shield is movable between a light transmission position and a light shield position. The linkage connects the contact element and the shield such that the shield is movable as the contact element pivots. The light receiver receives the light emitted from the light emitter when the shield is at the light transmission position. The shield at the light shield position shields the light receiver from the light emitted from the light emitter.

16 Claims, 13 Drawing Sheets

SHEET FEEDER AND IMAGE FORMING APPARATUS

CROSS-REFERENCE TO RELATED APPLICATION

This application claims priority from Japanese Patent Application No. 2019-158615 filed on Aug. 30, 2019, the content of which is incorporated herein by reference in its entirety.

TECHNICAL FIELD

Aspects disclosed herein relate to a sheet feeder and an image forming apparatus including the sheet feeder.

BACKGROUND

Some sheet feeders are known that feed a sheet from outside an apparatus to inside the apparatus. Such a sheet feeder includes a sheet tray for supporting sheets to be fed, a photosensor including a light emitter and a light receiver facing each other, and an actuator including a contact element and a shielding plate. The contact element is pivotable by contact with a sheet supported on the sheet tray. The shielding plate is configured to pass through between the light emitter and the light receiver in association with the rotation of the contact element. The sheet feeder is configured to detect the presence or absence of a sheet on the sheet tray depending on whether the shielding plate is between the light emitter and the light receiver.

The photosensor of the sheet feeder is configured to detect the presence or absence of a sheet on the sheet tray. The light receiver may, however, receive light from outside, and thereby false detection may occur.

Thus, it is known that, to reduce such false light detection, the actuator further includes a light shield to cover the photosensor.

SUMMARY

Aspects of the disclosure provide a sheet feeder to further help reducing effects of outside light on a photosensor.

According to one or more aspects of the disclosure, a sheet feeder includes a sheet tray, a feed roller, a sheet feed frame, a contact element, a guide frame, a photosensor, a shield, and a linkage. The feed roller is configured to feed a sheet on the sheet tray. The sheet feed frame holds the feed roller. The contact element is pivotable relative to the sheet feed frame. The guide frame is disposed below the sheet feed frame. The photosensor includes a light emitter for emitting a light and a light receiver for receiving the emitted light. The shield is movable between a light transmission position and a light shield position. The linkage connects the contact element and the shield such that the shield is movable in association with pivoting of the contact element. The light receiver receives the light emitted from the light emitter when the shield is at the light transmission position. The shield at the light shield position shields the light receiver from the light emitted from the light emitter.

This configuration may reduce effects of light from outside on the photosensor, and thus may prevent false light detection.

DETAILED DESCRIPTION

Illustrative embodiments of the disclosure will be described with reference to the accompanying drawings.

Image Forming Apparatus

Figure 1:
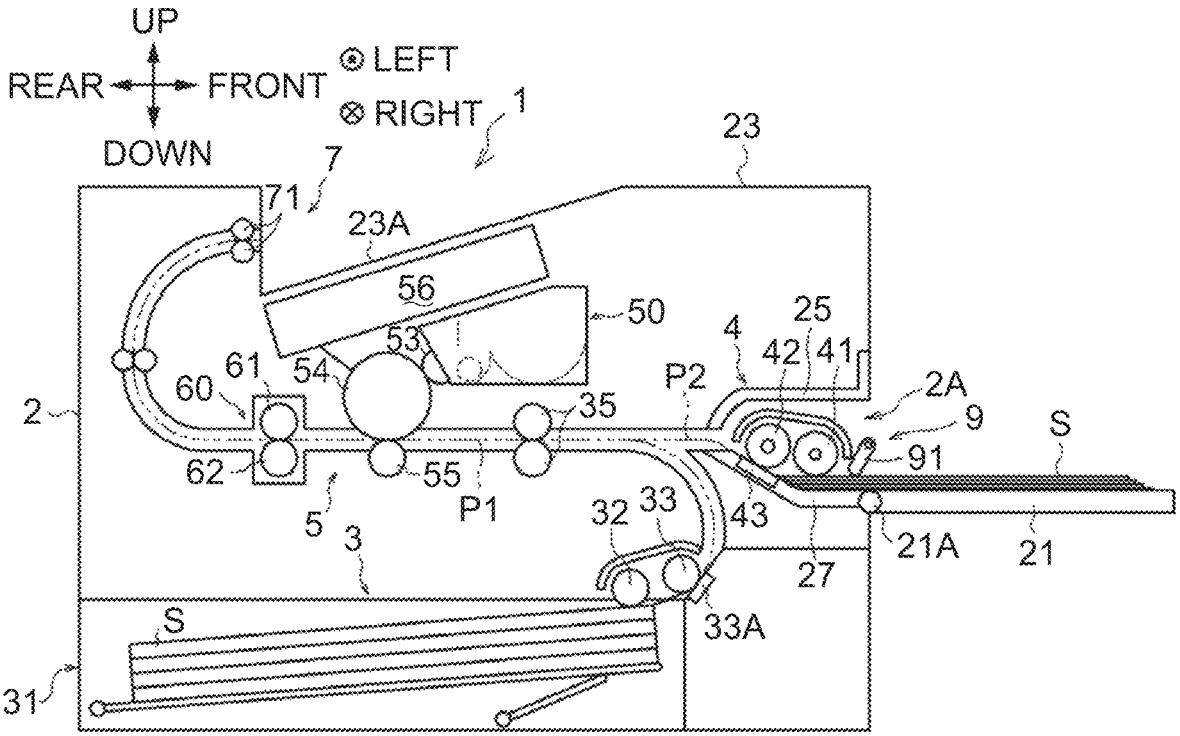
FIG. 1 is a cross-sectional view of an image forming apparatus including a sheet feeder according to an illustrative embodiment of the disclosure.

An image forming apparatus 1 illustrated in FIG. 1 is an example of an image forming apparatus including a sheet feeder according to an aspect of the disclosure. The image forming apparatus 1 includes a casing 2, a sheet feed unit 3, an image forming unit 5, a discharge unit 7, and a sheet feeder 4.

In the following description, right and left sides of the page of FIG. 1, a side facing out of the page of FIG. 1, and a side facing into the page of FIG. 1 are defined respectively as front, rear, left, and right sides of the image forming apparatus 1. Upper and lower sides of the page of FIG. 1 are defined respectively as upper and lower sides of the image forming apparatus 1.

The casing 2 is box-shaped, and accommodates the sheet feed unit 3, the image forming unit 5, the discharge unit 7, and the sheet feeder 4. The casing 2 has an opening 2A at its front and a multi-purpose tray (hereinafter referred to as a MP tray) 21 configured to open and close the opening 2A.

The MP tray 21 is an example of a sheet tray configured to support a sheet. The casing 2 has an upper surface covered by an upper cover 23.

The MP tray 21 is rotatable about a rotation axis 21A located at its lower end and extending horizontally in a left-right direction. The MP tray 21 is movable between a closed position to close the opening 2A and an open position to open the opening 2A. The MP tray 21 at the open position is configured to support one or more sheets S. FIG. 1 illustrates the MP tray 21 at the open position. The upper cover 23 includes a sheet discharge tray 23A inclined downward to the rear.

The sheet feed unit 3 includes a sheet cassette 31, a feed roller 32, a separation roller 33, a separation pad 33A, and a registration roller pair 35, and is configured to feed a sheet S from the sheet cassette 31 to the image forming unit 5. The casing 2 defines therein a conveyance path P1 extending from the sheet cassette 31 via the image forming unit 5 to the sheet discharge tray 23A.

The sheet cassette 31 is configured to accommodate a stack of sheets S. The feed roller 32 is configured to feed a sheet S from the sheet cassette 31, and the separation roller 33 and the separation pad 33A separate the sheet S from subsequent sheets S, so that the sheet S is singly conveyed toward the conveyance path P1.

The sheet S is then conveyed along the conveyance path P1 by the registration roller pair 35, which is located downstream from the separation roller 33, toward the image forming unit 5. The registration roller pair 35 temporarily stops feeding the sheet, aligns the leading end of the sheet S, and then starts rotating at a predetermined timing to convey the sheet S toward a transfer position in the image forming unit 5.

The image forming unit 5 is disposed above the sheet cassette 31 and configured to form an image on the sheet S. The image forming unit 5 includes a process cartridge 50 configured to transfer an image on a sheet S conveyed from the sheet feed unit 3, an exposure unit 56 configured to expose a surface of a photosensitive drum 54 in the process cartridge 50, and a fixing unit 60 configured to fix the image transferred on the sheet S by the process cartridge 50.

The process cartridge 50 includes a developing roller 53, the photosensitive drum 54, and a transfer roller 55. The exposure unit 56 includes a laser diode, a polygon mirror, a lens, and a reflecting mirror, and is configured to expose a surface of the photosensitive drum 54 by irradiating the surface with a laser beam based on image data inputted in the image forming apparatus 1 to expose the surface.

The photosensitive drum 54 is disposed adjacent to the developing roller 53. The surface of the photosensitive drum 54 is positively and uniformly charged by a charger, and then exposed by the exposure unit 56. Exposed areas on the surface of the photosensitive drum 54 are lower in electric potential than the other areas thereon, so that an electrostatic latent image is formed on the surface of the photosensitive drum 54 based on the image data. The electrostatic latent image on the surface of the photosensitive drum 54 is developed into a visible developer image with positively charged toner supplied from the developing roller 53.

The transfer roller 55 is disposed facing the photosensitive drum 54, and receives a negative transfer bias from a power source. While a sheet S is nipped at a transfer position between the transfer roller 55 and the photosensitive drum 54, the developer image on the photosensitive drum 54 is transferred to the sheet S due to the transfer bias.

The fixing unit 60 includes a heat roller 61 and a pressure roller 62. The heat roller 61 is configured to rotate by a drive force from the image forming apparatus 1, and is configured to be heated by a heater. The pressure roller 62 is disposed facing the heat roller 61 and is rotatable. The sheet S having the transferred developer image is conveyed to the fixing unit 60, in which the sheet S is nipped and conveyed by the heat roller 61 and the pressure roller 62, and thus the developer image is fixed onto the sheet S due to the heat.

The discharge unit 7 includes a discharge roller pair 71 configured to discharge the sheet S conveyed from the fixing unit 60 to the outside of the casing 2, specifically, to the sheet discharge tray 23A.

The sheet feeder 4 is disposed adjacent to the opening 2A of the casing 2 and configured to feed one or more sheets S on the MP tray 21 at the open position through the opening 2A of the casing 2 toward the image forming unit 5. The sheet feeder 4 includes a feed roller 41 to feed a sheet S, a separation roller 42 disposed downstream from the feed roller 41 in a conveyance direction in which a sheet S is conveyed, and a separation pad 43 disposed facing the separation roller 42. The feed roller 41, the separation roller 42, and the separation pad 43 are disposed substantially in the center of the casing 2 in the left-right direction corresponding to a width direction of a sheet S orthogonal to a sheet feed direction.

The sheet feeder 4 includes a sheet detector 9 to detect presence or absence of a sheet S on the MP tray 21. The sheet detector 9 includes a contact element 91 contactable with the sheet S on the MP tray 21. The sheet detector 9 is configured to detect the presence of the sheet S on the MP tray 21 when the contact element 91 contacts the sheet S. The casing 2 defines inside a sheet feed path P2, which is a part of the conveyance path P1, extending from the separation roller 42 to the registration roller pair 35.

The feed roller 41 is configured to feed a sheet S from the MP tray 21. The separation roller 42 and the separation pad 43 separate the sheet S from subsequent sheets S, so that the sheet S is singly conveyed toward the sheet feed path P2. The registration roller 35 is configured to further convey the sheet S conveyed along the sheet feed path P2 toward the image forming unit 5.

The sheet feeder 4 includes a sheet feed frame 25 located above the sheet feed path P2 and a guide frame 27 located below the sheet feed path P2. That is, the guide frame 27 is disposed below the sheet feed frame 25. The guide frame 27 includes an internal space. The feed roller 41, the separation roller 42, and the contact element 91 are held by the sheet feed frame 25. Leading ends of sheets S on the MP tray 21 contact the guide frame 27. A sheet S fed by the feed roller 41 is guided by the guide frame 27 and conveyed into the sheet feed path P2.

Figure 2:
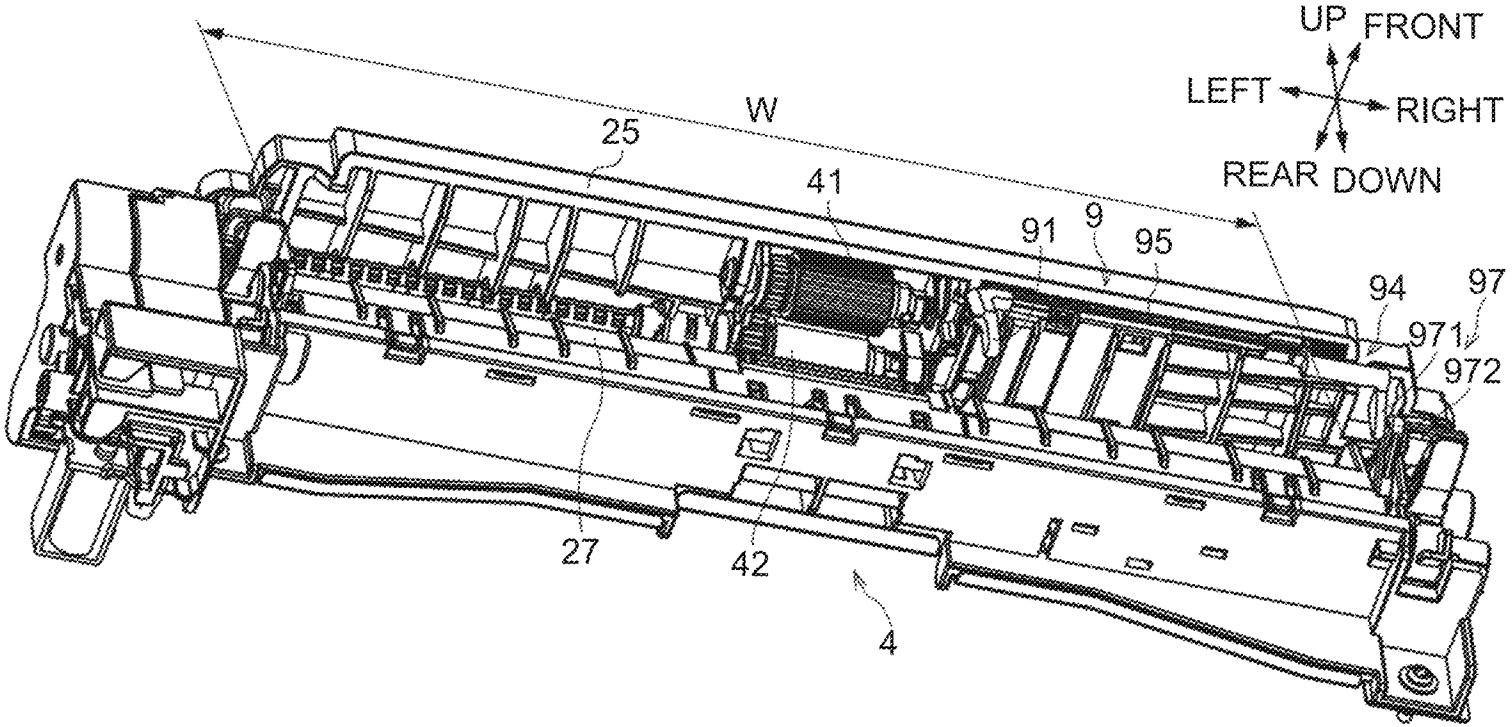
FIG. 2 is a perspective view of the sheet feeder.
Figure 3:
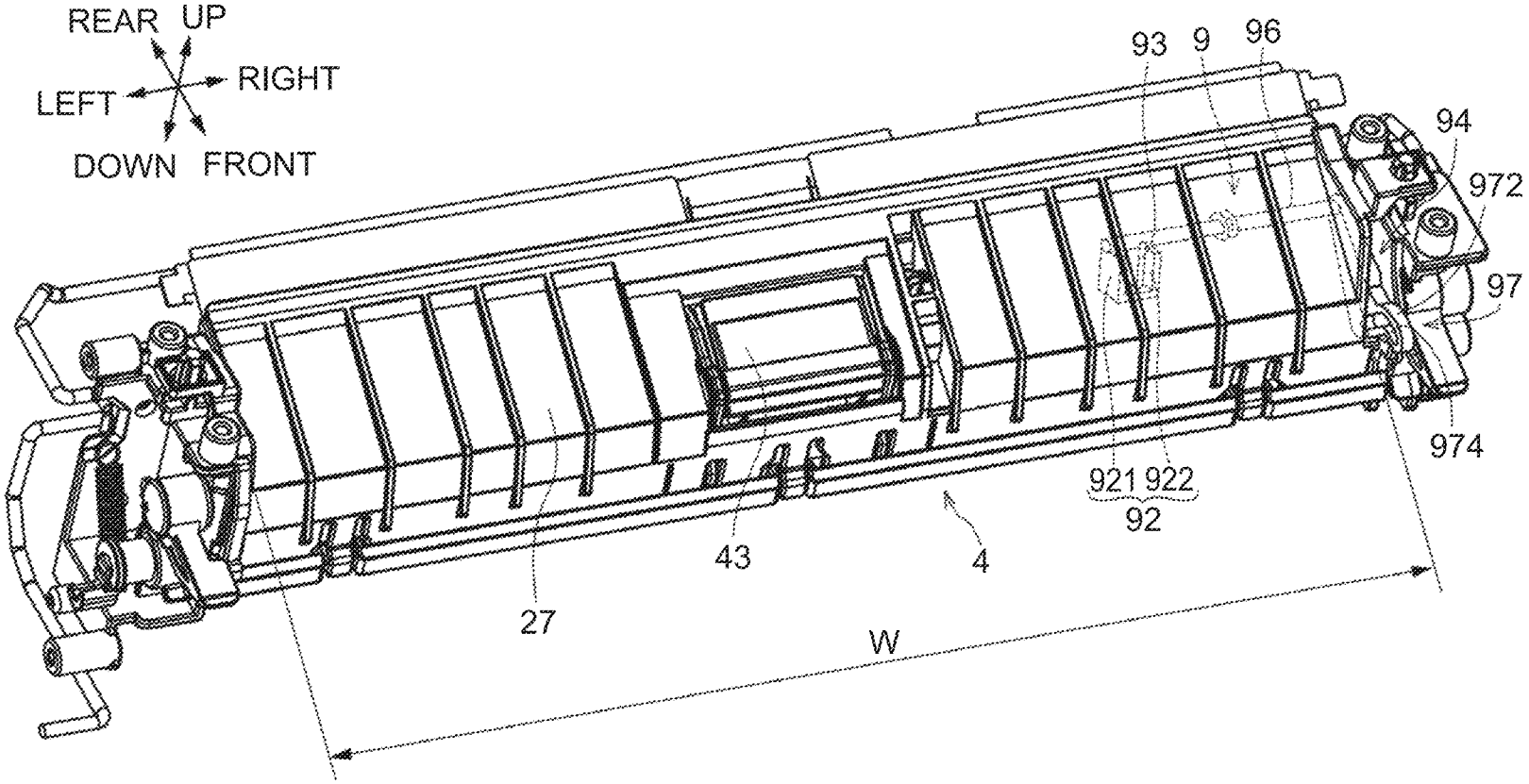
FIG. 3 is a perspective view of the sheet feeder viewed from a guide frame.
Figure 4:
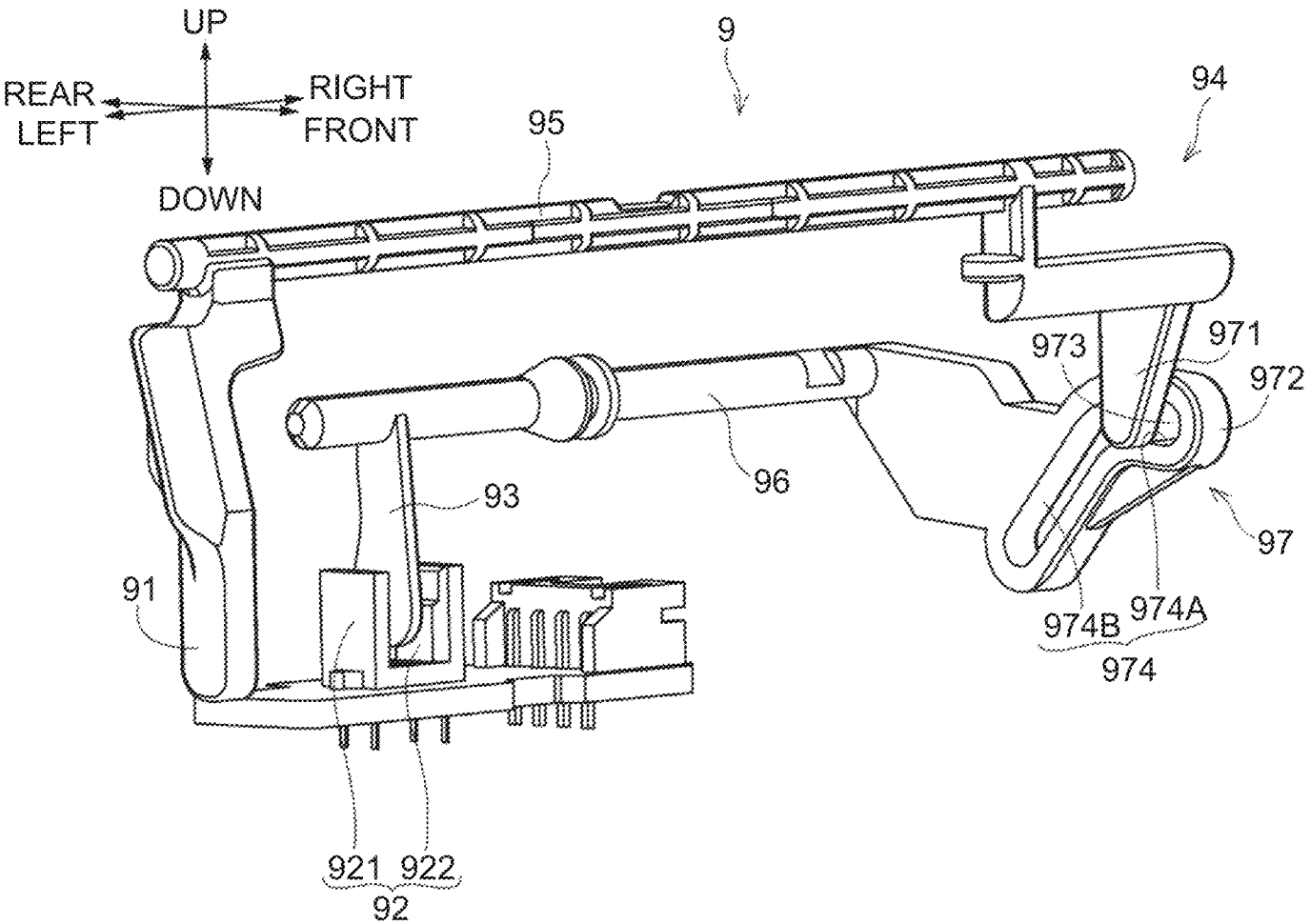
FIG. 4 is a perspective view of a sheet detector of the sheet feeder.

As illustrated in FIGS. 2 and 3, the sheet feeder 4 has a sheet feed range W extending in the left-right direction. The sheet feed range W corresponds to a maximum size, in the left-right direction, of a sheet supportable on the MP tray 21. The guide frame 27 is disposed within the sheet feed range W in the left-right direction.

Sheet Detector

As illustrated in FIGS. 2 to 5B, the sheet detector 9 includes the contact element 91, a photosensor 92, a shield 93, and a linkage 94.

Figure 5A:
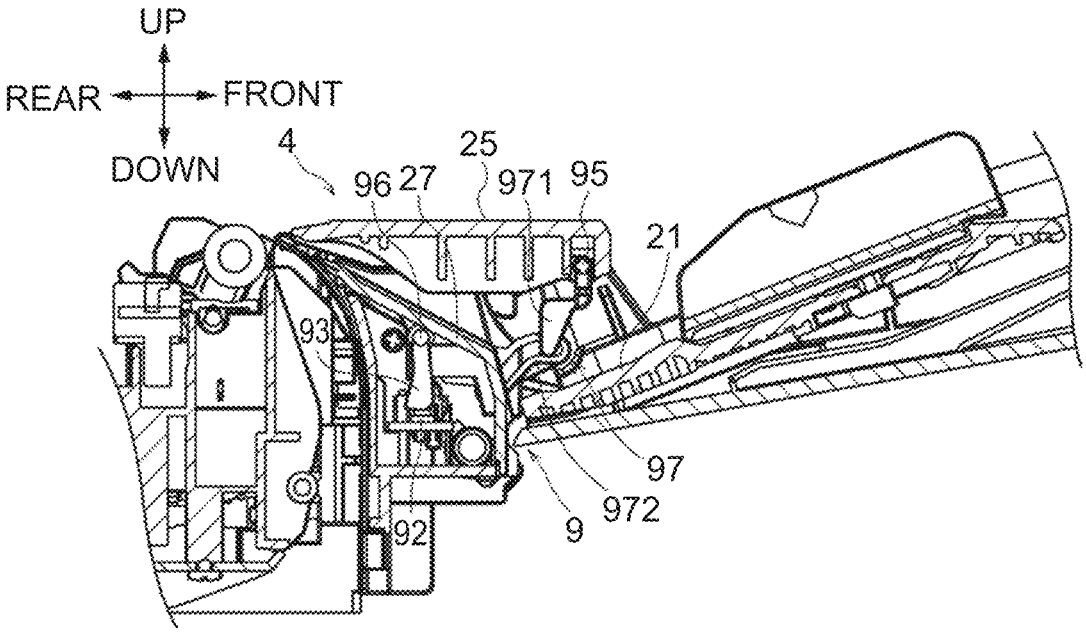
FIG. 5A is a cross-sectional view of the sheet feeder.
Figure 5B:
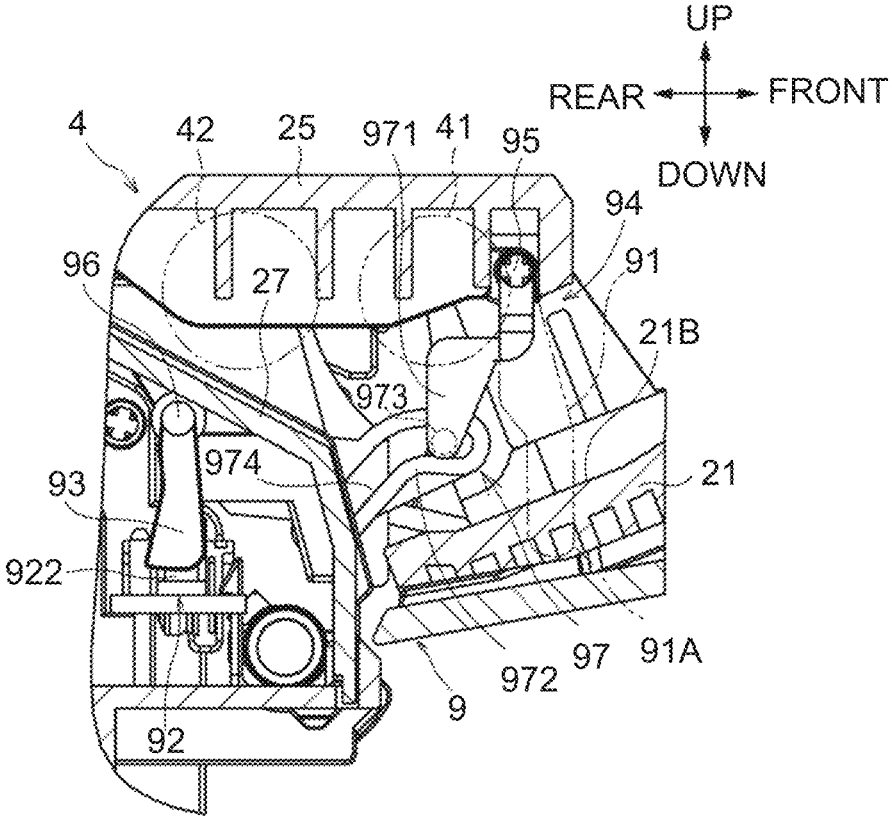
FIG. 5B is a cross-sectional view of the sheet detector when no sheets are supported on a MP tray.

The contact element 91 is a tongue-shaped part extending downward from the sheet feed frame 25, and pivotably supported by the sheet feed frame 25. The contact element 91 is located upstream from the feed roller 41 in a sheet feed direction in which a sheet S is fed. As illustrated in FIG. 5B where no sheets S are on the MP tray 21, an end 91*a* of the contact element 91 is located below a sheet support surface 21B of the MP tray 21. The contact element 91 is located on one side of the separation roller 42 in the left-right direction. In this embodiment, the contact element 91 is disposed to the right of the separation roller 42.

The photosensor 92 is located in the internal space of the guide frame 27 and includes a light emitter 921 for emitting light and a light receiver 922 for receiving light emitted from the light emitter 921. The light emitter 921 and the light receiver 922 are spaced from each other in the left-right direction.

The shield 93 is a plate-like member located in the internal space of the guide frame 27 and is movable, e.g., pivotable, between a light transmission position to allow transmission of light emitted from the light emitter 921 to the light receiver 922 and a light shield position to shield the light receiver 922 from light emitted from the light emitter 921.

The shield 93 at the light shield position is located between the light emitter 921 and the light receiver 922 to shield the light receiver 922 from light emitted from the light emitter 921. The photosensor 92 is configured to, when the light receiver 922 is shielded from the light emitted from the light emitter 921, detect that no sheets S are on the MP tray 21.

The shield 93 at the light transmission position is located away from a position between the light emitter 921 and the light receiver 922, thereby allowing the light receiver 922 to receive light emitted from the light emitter 921. The photosensor 92 is configured to, in response to that the light receiver 922 receives the light emitted from the light emitter 921, detect that a sheet S is on the MP tray 21.

The linkage 94 connects the contact element 91 and the shield 93 such that the shield 93 is movable, e.g., pivotable, in association with pivoting of the contact element 91. The linkage 94 includes a first extension 95, a second extension 96, and a connection 97.

The first extension 95 is a shaft extending from the contact element 91 toward one side in the left-right direction beyond the sheet feed range W. In this embodiment, the first extension 95 extends from the contact element 91 to the right. The first extension 95 is rotatably supported by the sheet feed frame 25. The contact element 91 is pivotable about the first extension 95.

The second extension 96 is a shaft extending from the shield 93 toward one side in the left-right direction beyond the sheet feed range W. In this embodiment, the second extension 96 extends from the shield 93 to the right. The second extension 96 is rotatably supported by the guide frame 27. The shield 93 is pivotable about the second extension 96. The first extension 95 is located upstream from the second extension 96 in the sheet feed direction and above the second extension 96 in an up-down direction.

The connection 97 connects the first extension 95 and the second extension 96 outside the sheet feed range W in the left-right direction. The connection 97 is located outside the sheet feed range W in the left-right direction, and thus may be prevented from interfering with a sheet S to be fed in the sheet feed range W. The connection 97 includes a first connection 971, a second connection 972, a boss 973, and a slide groove 974, which are all located outside of the sheet feed range W in the left-right direction.

The first connection 971 extends from the first extension 95 toward the second extension 96. The first connection 971 is pivotable about the first extension 95 as the contact element 91 pivots. The second connection 972 extends from the second extension 96 toward the first extension 95. The second connection 972 and the shield 93 are integrally pivotable about the second extension 96 integrally with the shield 93.

The boss 973 is located at the first connection 971 and protrudes from the first connection 971 to the right. The slide groove 974 is defined in the second connection 972 and receives the boss 973 slidably. The boss 973 located at the first connection 971 is engaged in the slide groove 974 defined in the second connection 972, thereby the first extension 95 communicating with the second extension 96.

The shield 93 is located downstream from the contact element 91 in the sheet feed direction. The boss 973 is located downstream from the contact element 91 in the sheet feed direction, more specifically, closer to the shield 93 than the contact element 91. The slide groove 974 is located upstream from the shield 93 in the sheet feed direction, more specifically, closer to the contact element 91 than the shield 93.

The contact element 91 pivots integrally with the first connection 971 as contacting with a sheet S on the MP tray 21, and the boss 973 pivots as the first connection 971 pivots. The boss 973 slides in the slide groove 974 while pivoting, thereby pivoting the second connection 972 which in turn pivots the shield 93.

In this embodiment, the boss 973 is located at the first connection 971 and the slide groove 974 is defined in the second connection 972. In some embodiments, the boss 973 may be located at the second connection 972 and the slide groove 974 may be defined in the first connection 971.

In the sheet detector 9 structured as above, when no sheets S are on the MP tray 21, that is, when the contact element 91 is in an initial state out of contact with any sheet S, as illustrated in FIG. 5B, the contact element 91 protrudes downward from the first extension 95 and the end 91*a* of the contact element 91 is located below the sheet support surface 21B of the MP tray 21. When no sheets S are on the MP tray 21, the shield 93 is at the light shield position so the light receiver 922 is shielded from the light emitted from the light emitter 921. In this state, the light receiver 922 does not receive the light emitted from the light emitter 921 so the photosensor 92 detects that no sheets S are on the MP tray 21.

Figure 6A:
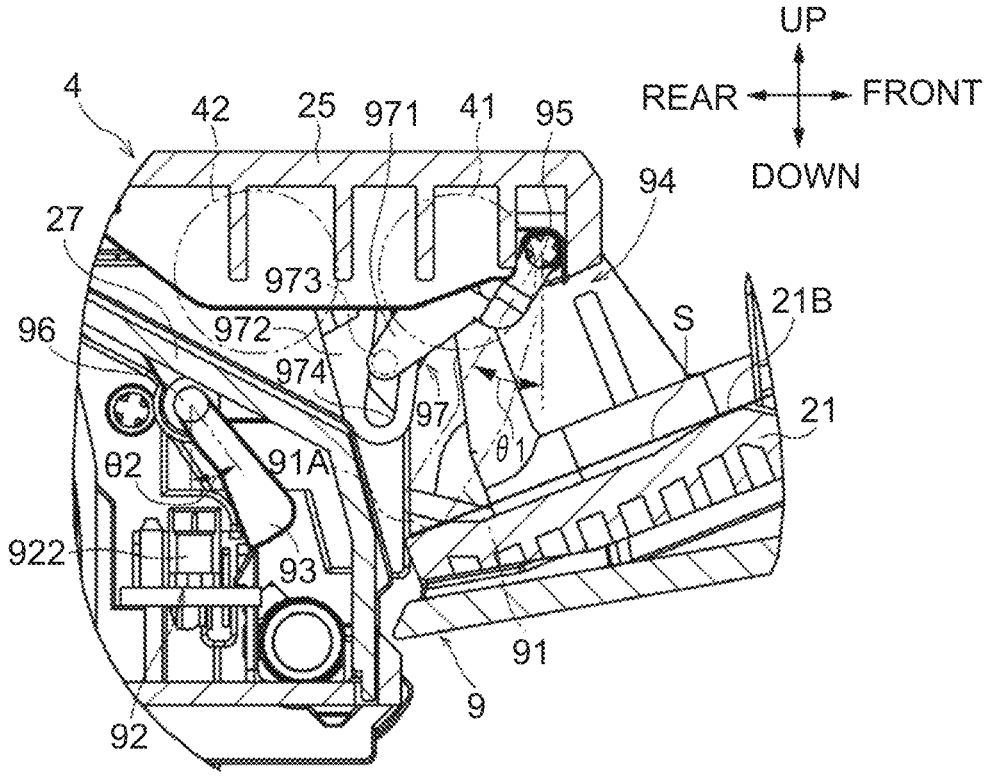
FIG. 6A is a cross-sectional view of the sheet detector when one sheet is supported on the MP tray.

As illustrated in FIG. 6A, in a state where one sheet S is on the MP tray 21, the contact element 91 pivots, as contacting with the sheet S, further downstream in the sheet feed direction than when no sheets S are on the MP tray 21. The shield 93 pivots further frontward than when no sheets S are on the MP tray 21, that is, moves from the light shield position to the light transmission position. In this state, the light receiver 922 receives the light emitted from the light emitter 921 so the photosensor 92 detects that a sheet S is on the MP tray 21.

Figure 6B:
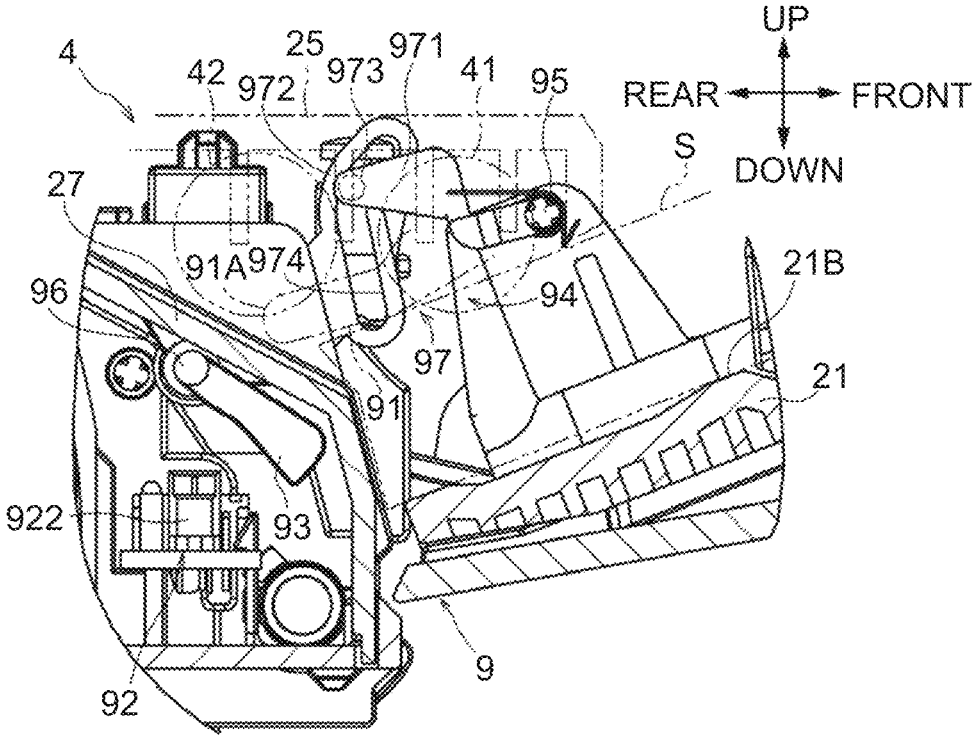
FIG. 6B is a cross-sectional view of the sheet detector when the maximum number of sheets are supported on the MP tray.

As illustrated in FIG. 6B, in a state where the maximum number of sheets S are on the MP tray 21 (i.e., the MP tray 21 is in its full load state), the contact element 91 pivots, as contacting with a topmost sheet S, further downstream in the sheet feed direction than when one sheet S is on the MP tray 21. The shield 93 pivots further frontward than when one sheet S is on the MP tray 21, and maintains its light transmission position. In this state, the light receiver 922 receives the light emitted from the light emitter 921 so the photosensor 92 detects that a sheet S is on the MP tray 21.

In the sheet detector 9, the photosensor 92 is located inside the guide frame 27, i.e., located in the internal space of the guide frame 27, which is disposed below the sheet feed frame 25. The guide frame 27 shields and prevents stray light from outside from entering the light receiver 922. This structure sufficiently reduces effects of light from outside the photosensor 92, and thus reduces false detection of a sheet S on the MP tray 21.

As the number of sheets S on the MP tray 21 changes from zero to one or more, the contact element 91 protruding downward pivots downstream in the sheet feed direction. The greater the number of sheets S on the MP tray 21, the greater the angle of the contact element 91 pivoting downward in the sheet feed direction. The shield 93 is configured to pivot to move from the light shield position to the light transmission position, as the linkage 94 communicates the pivoting movement of the contact element 91 to the shield 93.

Figure 7:
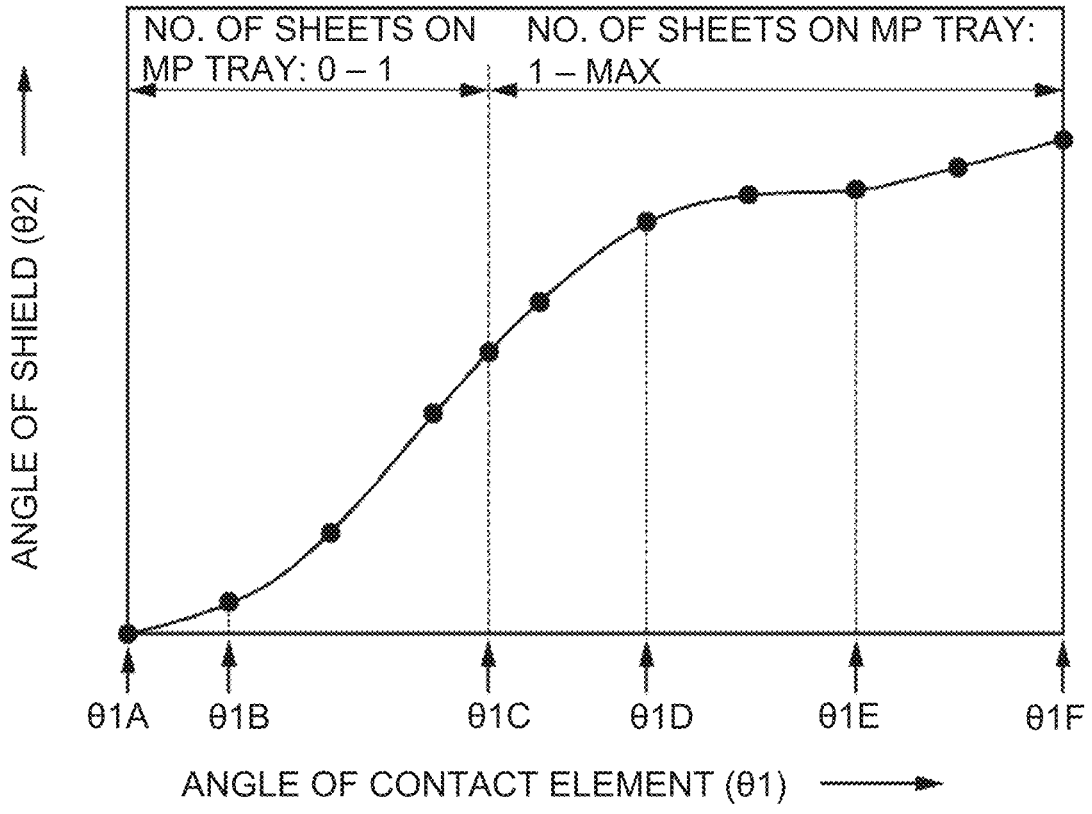
FIG. 7 is a graph illustrating a relationship between the angle of a contact element and the angle of a shield, wherein the contact element and the shield are included in the sheet detector.

In this embodiment, an angle of the contact element 91 relative to the vertical direction is represented by θ1, and an angle of the shield 93 relative to the vertical direction is represented by θ2 as shown in FIG. 6A. As illustrated in FIG. 7, the amount of change in the angle θ2 relative to the amount of change in the angle θ1 is less when the number of sheets S on the MP tray 21 changes from one to the maximum than when the number of sheets S on the MP tray 21 changes from zero to one. In FIG. 7, the angle θ1C of the contact element 91 indicates the angle θ1 of the contact element 91 when one sheet S is on the MP tray 21.

The linkage 94 is configured to communicate movement of the contact element 91 to the shield 93 such that a pivoting amount of the shield 93 according to a pivoting amount of the contact element 91 is less when the number of sheets S on the MP tray 21 changes from one to two or more than when the number of sheets S on the MP tray 21 changes from zero to one.

As the number of sheets S on the MP tray 21 changes from zero to one, to enable the photosensor 92 to detect that a sheet S is on the MP tray 21, the shield 93 is preferably structured to have a relatively great amount of movement such that the shield 93 moves from the light shield position to the light transmission position.

In contrast, while the number of sheets on the MP tray 21 changes from one and reaches the maximum, the shield 93 moves slightly and is maintained at the light transmission position such that the movement of the shields 93 produces no significant effect on sheet detection. Because the moving amount of the shield 93 according to the pivoting amount of the contact element 91 is small, a small space is enough to allow the shield 93 moving inside the guide frame 27, thereby facilitating accommodation of the shield 93 inside the guide frame 27.

Thus, the moving amount of the shield 93 according to the pivoting amount of the contact element 91 is set to be great enough when the number of sheets S on the MP tray 21 changes from zero to one, and is set to be less while the number of sheets Son the MP tray 21 reaches the maximum from one than when the number of sheets S on the MP tray 21 changes from zero to one.

The connection 97 of the linkage 94 is structured so that the moving amount of the shield 93 according to the pivoting amount of the contact element 91 when the number of sheets S changes from one to two or more is less than when the number of sheets S on the MP tray 21 changes from zero to one.

Movement of Shield Corresponding to Pivoting of Contact Element

Figure 8A:
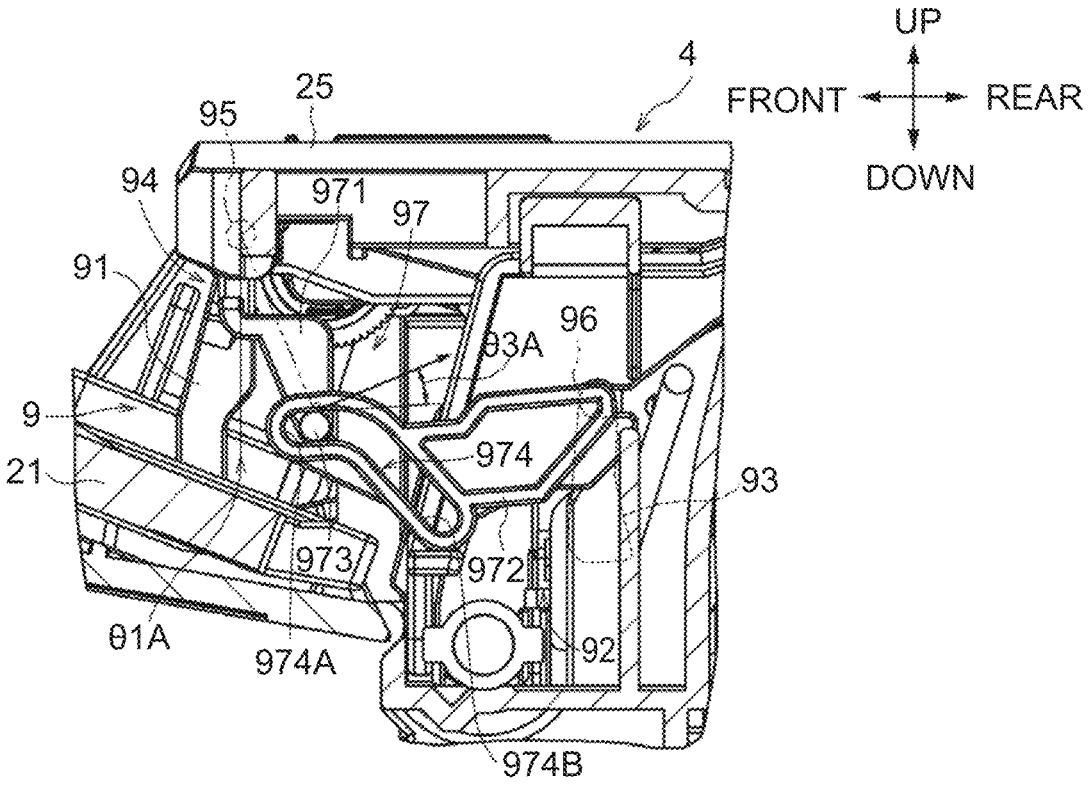
FIG. 8A is a cross-sectional view of the sheet detector when the angle of the contact element is θ1A.

FIG. 8A illustrates the sheet detector 9 when no sheets S are on the MP tray 21, that is, when the contact element 91 is in the initial state out of contact with any sheet S. As illustrated in FIG. 8A, the slide groove 974 defined in the second connection 972 of the connection 97 has a first groove portion 974A and a second groove portion 974B.

The first groove portion 974A extends in the sheet feed direction from a position of the boss 973 located when the contact element 91 is in the initial state out of contact with any sheet S, toward the shield 93. In other words, when the contact element 91 is in the initial state, the first groove portion 974A is elongated in the front-rear direction along the sheet feed direction.

The second groove portion 974B extends continuously from the first groove portion 974A diagonally downward relative to the sheet feed direction. When the contact element 91 is in the initial state, the second groove portion 974B is inclined relative to the horizontal direction and elongated diagonally downward to the rear.

The boss 973 is slidably engageable in the slide groove 974 having the first groove portion 974A and the second groove portion 974B, thereby moving the shield 93 in association with the pivoting of the contact element 91.

As illustrated in FIG. 8A, the contact element 91 in the initial state extends downward and the angle θ1 of the contact element 91 relative to the vertical direction is θ1A)(=0°). In the initial state, the boss 973 is in a front portion of the first groove portion 974A, and the shield 93 is at the light shield position. When the contact element 91 pivots from the initial state in the sheet feed direction, the first connection 971 having the boss 973 pivots to the rear about the first extension 95. When the first connection 971 pivots to the rear, the boss 973 moves diagonally upward to the rear.

When the contact element 91 is in the initial state, an inner peripheral surface of the first groove portion 974A and a moving direction of the boss 973 form an angle represented by θ3*a*. When the contact element 91 in the initial state starts pivoting, the second connection 972 having the slide groove 974 pivots upward about the second connection 96 and the shield 93 moves to the front.

Figure 8B:
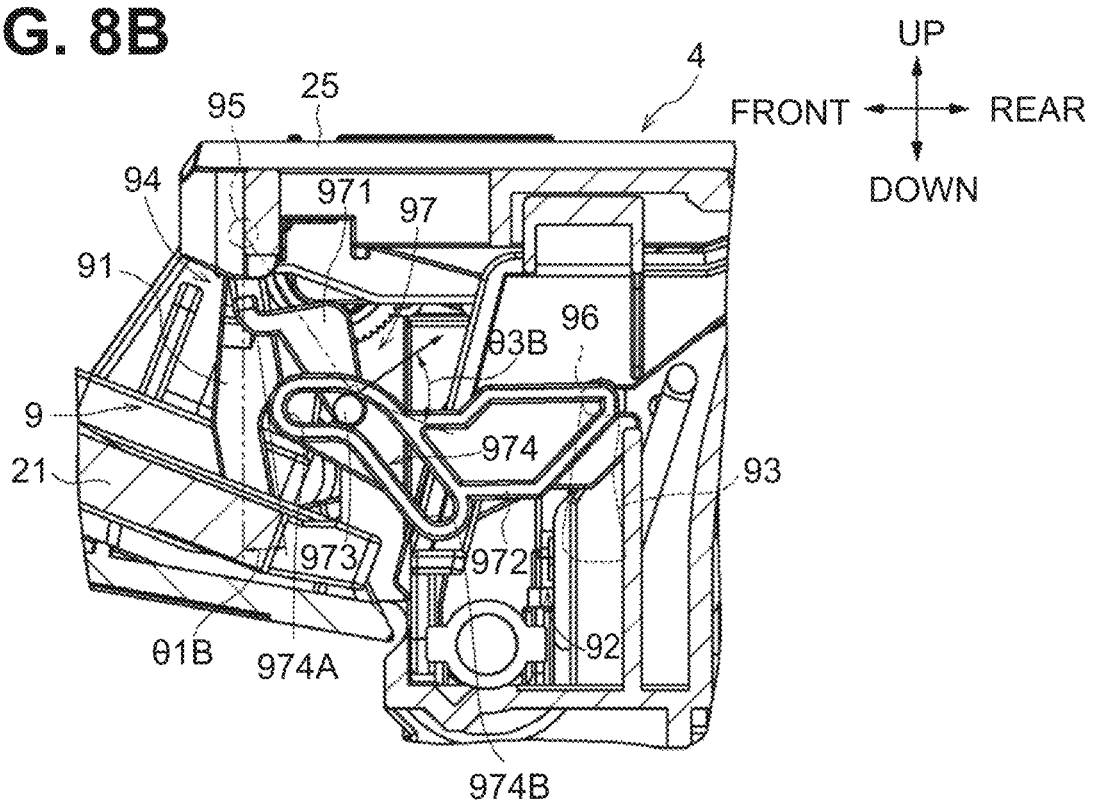
FIG. 8B is a cross-sectional view of the sheet detector when the angle of the contact element is θ1B.

As illustrated in FIG. 8B, when the contact element 91 in the initial state pivots until the angle θ1 of the contact element 91 relative to the vertical direction becomes θ1B, where θ1B is greater than θ1A, the boss 973 is in a rear end portion of the first groove portion 974A and the angle formed between the inner peripheral surface of the first groove portion 974A and the moving direction of the boss 973 is θ3B. In this case, the second connection 972 pivots upward about the second extension 96 by the pivoting of the contact element 91, and thus the shield 93 moves to the front.

Figure 9A:
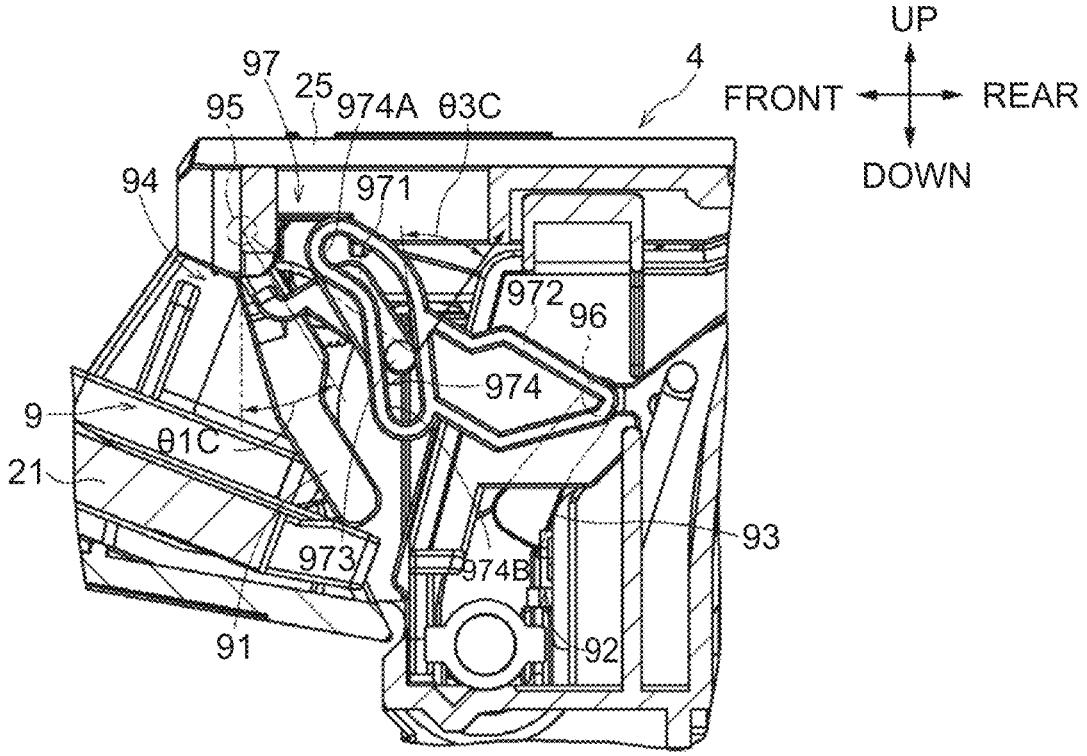
FIG. 9A is a cross-sectional view of the sheet detector when the angle of the contact element is θ1C.

As the contact element 91 further pivots from the state illustrated in FIG. 8B so that the angle θ1 becomes θ1C, where θ1C is greater than θ1B, the boss 973 moves from the first groove portion 974A to the second groove portion 974B and reaches a middle portion of the second groove portion 974B, as illustrated in FIG. 9A. When the angle θ1 of the contact element 91 relative to the vertical direction is θ1C, one sheet S is on the MP tray 21.

In this state, the angle formed between the inner peripheral surface of the first groove portion 974*a* and the moving direction of the boss 973 is θ3C. In this case, the second connection 972 pivots upward about the second extension 96 by the pivoting of the contact element 91, and thus the shield 93 moves to the front. This allows the shield 93 to move, i.e., pivot, from the light shield position to the light transmission position.

The angles θ3A, θ3B, and θ3C 3 correspond to the angles θ1A, θ1B, and θ1C, respectively, and each of the angles θ3A, θ3B, and θ3C has a relatively great value.

Figure 9B:
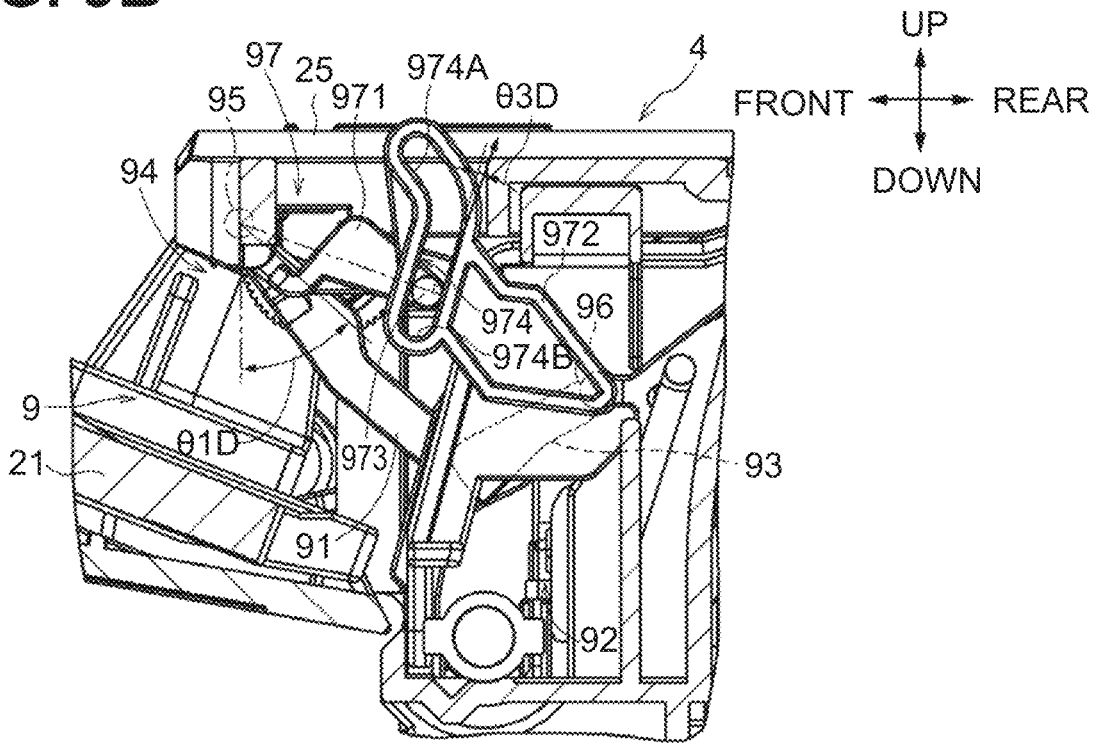
FIG. 9B is a cross-sectional view of the sheet detector when the angle of the contact element is θ1D.

As the contact element 91 further pivots from the state illustrated in FIG. 9A so that the angle θ1 becomes θ1D, where θ1D is greater than θ1C, the boss 973 moves along the second groove portion 974B from a position illustrated in FIG. 9A and reaches a position opposite to the first groove portion 974A in the up-down direction, as illustrated in FIG. 9B. In this state, the angle formed between the inner peripheral surface of the first groove portion 974A and the moving direction of the boss 973 is θ3D.

In this case, the second connection 972 pivots upward about the second extension 96 as the contact element 91 pivots, and thus the shield 93 moves to the front. The angle θ3D is less than any of the angles θ3A, θ3B, and θ3C, and the moving amount of the shield 93 according to the pivoting amount of the contact element 91 is less than when the angle θ1 is in the range of θ1A to θ1C.

Figure 10A:
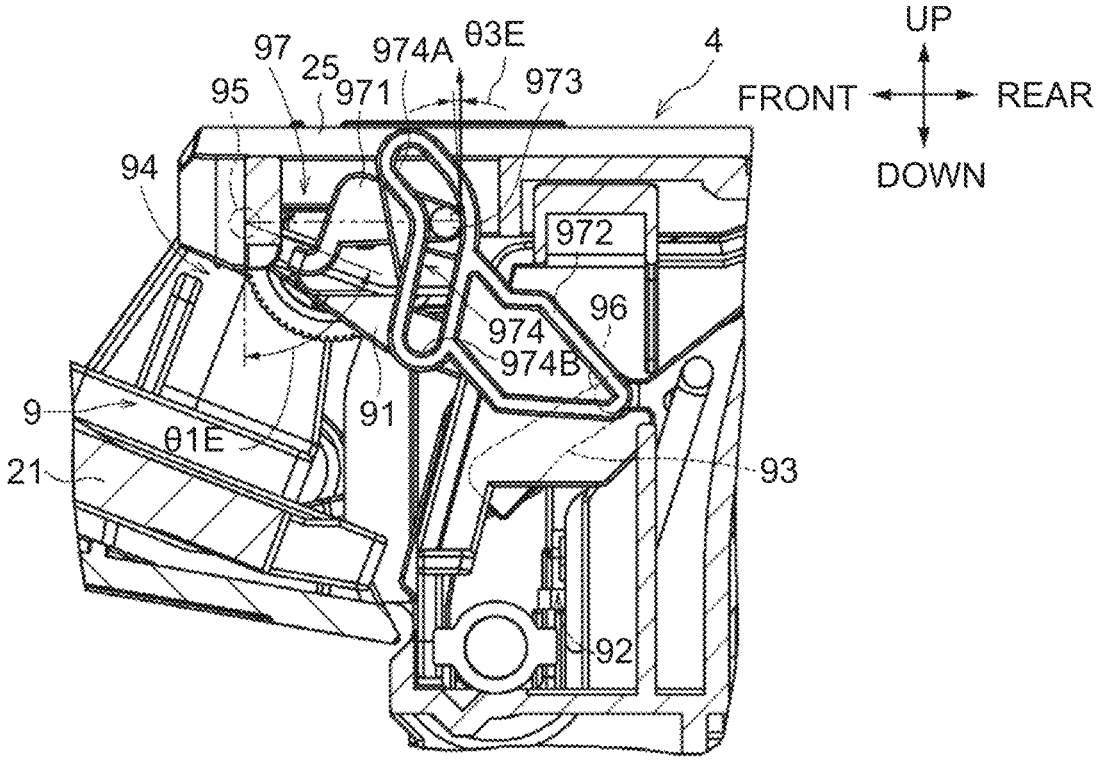
FIG. 10A is a cross-sectional view of the sheet detector when the angle of the contact element is θ1E.
Figure 10B:
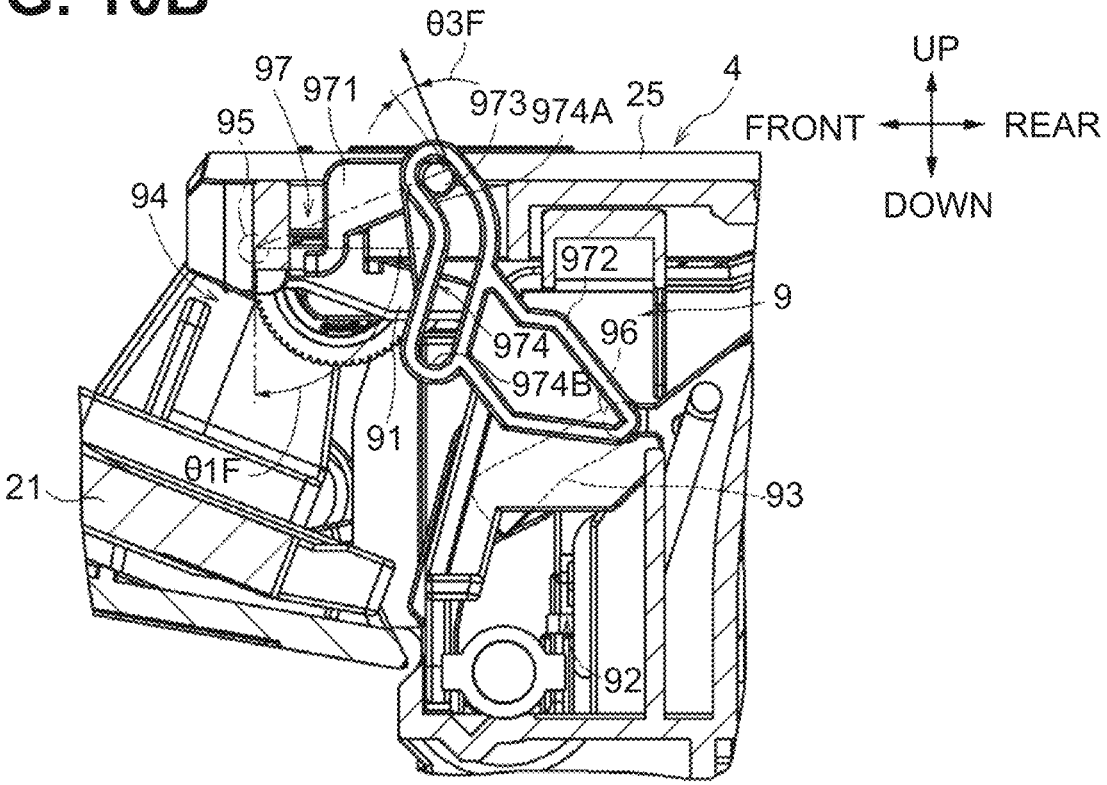
FIG. 10B is a cross-sectional view of the sheet detector when the angle of the contact element is θ1F.

As the contact element 91 further pivots from the state illustrated in FIG. 9B so that the angle θ1 becomes θ1E, where θ1E is greater than θ1D, the boss 973 moves along the second groove portion 974B toward the first groove portion 974A and reaches an end portion of the second groove portion 974B adjacent to the first groove portion 974A, as illustrated in FIG. 10A. In this state, the angle formed between the inner peripheral surface of the first groove portion 974A and the moving direction of the boss 973 is θ3E.

In this case, the second connection 972 pivots upward about the second extension 96 as the contact element 91 pivots, and thus the shield 93 moves to the front. When the angle θ1 is θ1E, the angle θ3E is less than any of the angles θ3A, θ3B, and θ3C, and the moving amount of the shield 93 according to the pivoting amount of the contact element 91 is less than when the angle θ1 is in the range of θ1A to θ1C.

As the contact element 91 further pivots from the state illustrated in FIG. 9B so that the angle θ1 becomes θ1F, where θ1F is greater than θ1E, the boss 973 moves along the second groove portion 974B toward the first groove portion 974A and reaches an end portion of the second groove portion 974B adjacent to the first groove portion 974A, as illustrated in FIG. 10A. When the angle θ1 of the contact element 91 relative to the vertical direction is θ1F, the MP tray 21 is in the full load state so that the maximum number of sheets S are on the MP tray 21.

In this state, the angle formed between the inner peripheral surface of the first groove portion 974A and the moving direction of the boss 973 is θ3F. In this case, the second connection 972 pivots upward about the second extension 96 as the contact element 91 pivots, and thus the shield 93 moves to the front. When the angle θ1 is θ1F, the angle θ3F is less than any of the angles θ3A, θ3B, and θ3C, and the moving amount of the shield 93 according to the pivoting amount of the contact element 91 is less than when the angle θ1 is in the range of θ1A to θ1C.

Thus, in the sheet detector 9, each of the angles θ3D, θ3E, and θ3F between the inner peripheral surface of the first groove portion 974A and the moving direction of the boss 973 when the angle θ1 of the contact element 91 relative to the vertical direction is in a range of θ1D to θ1F, is less than any of the angles θ3A, θ3B, and θ3C when the angle θ1 is in a range of θ1A to θ1C.

Thus, the moving amount of the shield 93 according to the pivoting amount of the contact element 91 can be set smaller when the angle θ1 is in a range of θ1D to θ1F than when the angle θ1 is in a range of θ1A to θ1C.

In other words, the moving amount of the shield 93 corresponding to the pivoting amount of the contact element 91 can be determined by altering the shapes of the first groove portion 974A and the second groove portion 974B of the slide groove 974. This embodiment illustrates that the first groove portion 974A extends in the sheet feed direction from the position of the boss 973 located when the contact element 91 is in the initial state out of contact with any sheet S, toward the shield 93, and the second groove portion 974B extends continuously from the first groove portion 974A diagonally downward relative to the sheet feed direction.

This configuration enables adjustment of the moving amount of the shield 93 according to the pivoting amount of the contact element 91 such that the moving amount of the shield 93 of when the number of sheets S on the MP tray 21 changes from one to two or more is less than the moving amount of the shield 93 of when the number of sheets S on the MP tray 21 changes from zero to one. This facilitates accommodation of the shield 93 inside the guide frame 27.

The boss 973 is pivotable together with the contact element 91. The slide groove 974 is defined in the connection 97 integrally movable with the shield 93. Slidable engagement of the boss 973 in the slide groove 974 enables easy adjustment of the moving amount of the shield 93 according to the pivoting amount of the contact element 91.

Alternative Embodiments

The above embodiment illustrates that the shield 93 and the second connection 972 of the connection 97 are connected by the second extension 96 and are thus integrally movable, e.g., pivotable, about the second extension 96. In some embodiments, however, the shield 93 and the second connection 972 may be connected as follows.

Figure 11A:
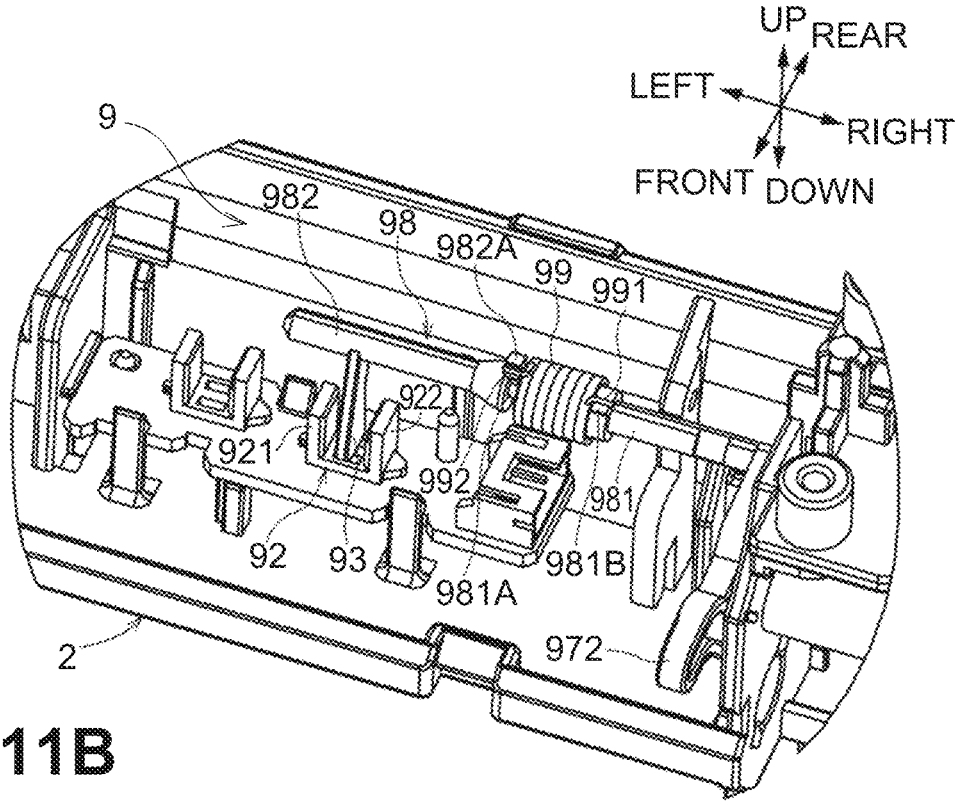
FIG. 11A is a perspective view of a sheet detector according to an alternative embodiment of the disclosure, wherein the sheet detector includes a second extension having a first shaft and a second shaft.

Referring to FIGS. 11A to 13B, a sheet detector 9 according to an alternative embodiment will be described. In the following description, elements identical to those described in the above embodiment are designated by identical reference numerals and thus the detail description thereof may be eliminated for the sake of brevity. As illustrated in FIG. 11A, the sheet detector 9 includes a second extension 98 that connects the shield 93 and the second connection 972. The second extension 98 is a shaft extending in the left-right direction and includes a first shaft 981 and a second shaft 982. The first shaft 981 has an insertion shaft portion 981A inserted into the second shaft 982 rotatably relative thereto. The first shaft 981 and the second shaft 982 are rotatably connected by inserting the insertion shaft portion 981A into the second shaft 982.

The insertion shaft portion 981*a* is located at a left end portion of the first shaft 981. The second connection 972 is fixed at a right end portion of the first shaft 981. The shield 93 is fixed at a left end portion of the second shaft 982. The first shaft 981 has a first engagement piece 981B protruding from its outer surface, and the second shaft 982 has a second engagement piece 982A protruding from its outer surface.

A coil spring 99 is wound around the first shaft 981 and located between the first engagement piece 981B and the second engagement piece 982A. The coil spring 99 has a first engagement portion 991 engaging with the first engagement piece 981*b* and a second engagement portion 992 engaging with the second engagement piece 982A.

Figure 11B:
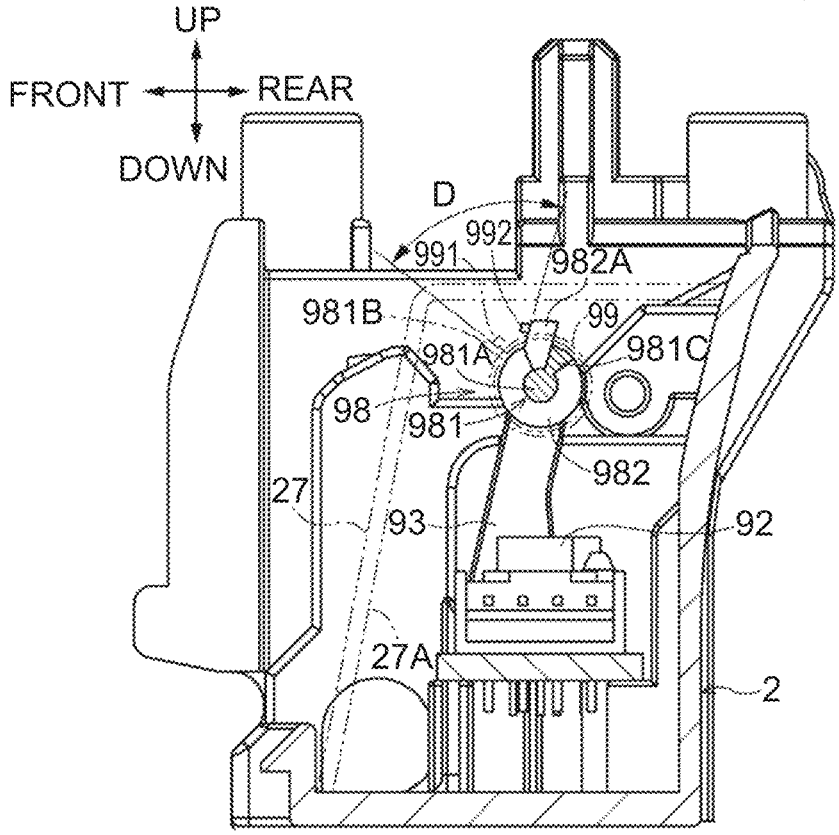
FIG. 11B is a cross-sectional view of the sheet detector when a contact element is at its initial state.

The coil spring 99 urges the first shaft 981 and the second shaft 982 in their circumferential directions to increase an acute angle D formed between the first engagement piece 981*b* and the second engagement piece 982A as shown in FIG. 11B. The insertion shaft portion 981A of the first shaft 981 has a restriction piece 981C to restrict the angle D from increasing any further by contact with the second engagement piece 982A of the second shaft 982.

The coil spring 99 urges the second engagement piece 982A and the restriction piece 981C so as to contact with each other. When no external force acts on the shield 93, the first shaft 981 and the second shaft 982 are rotatable integrally.

As illustrated in FIG. 11B, when the contact element 91 is in the initial state where the contact element 91 protrudes downward from the first extension 95 because no sheet S is on the MP tray 21, the restriction piece 981*c* of the first shaft 981 and the second engagement piece 982A of the second shaft 982 are in contact with each other and the shield 93 is located at the light shield position.

Figure 12A:
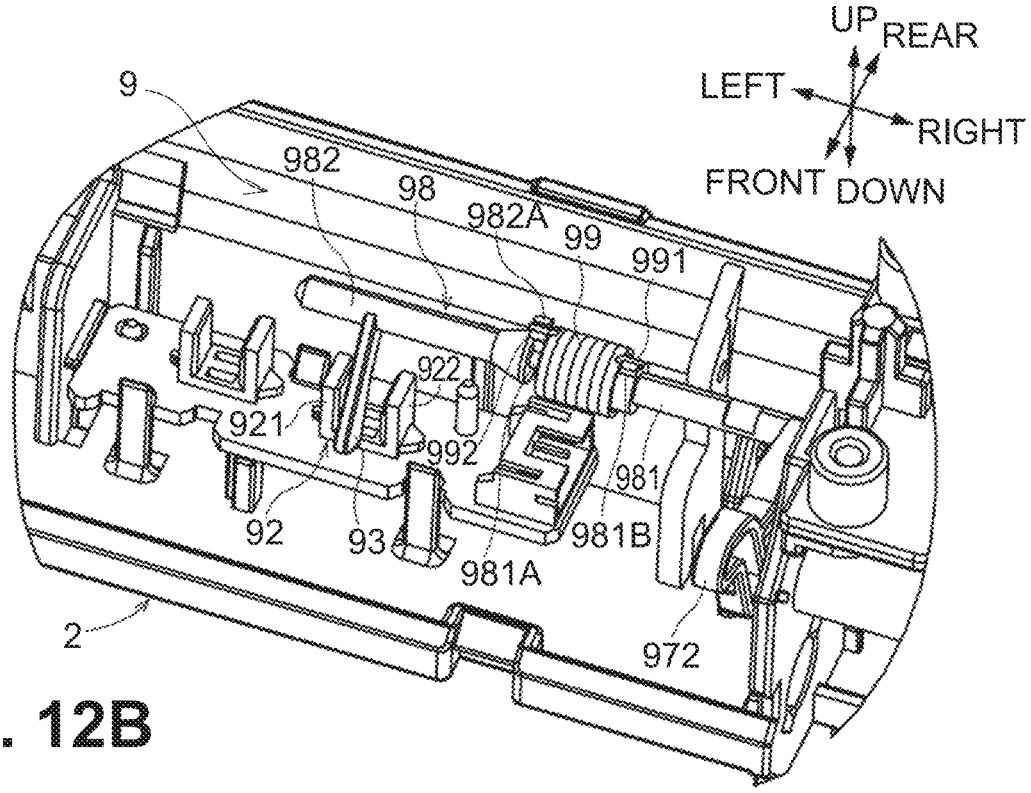
FIG. 12A is a perspective view of the sheet detector.
Figure 12B:
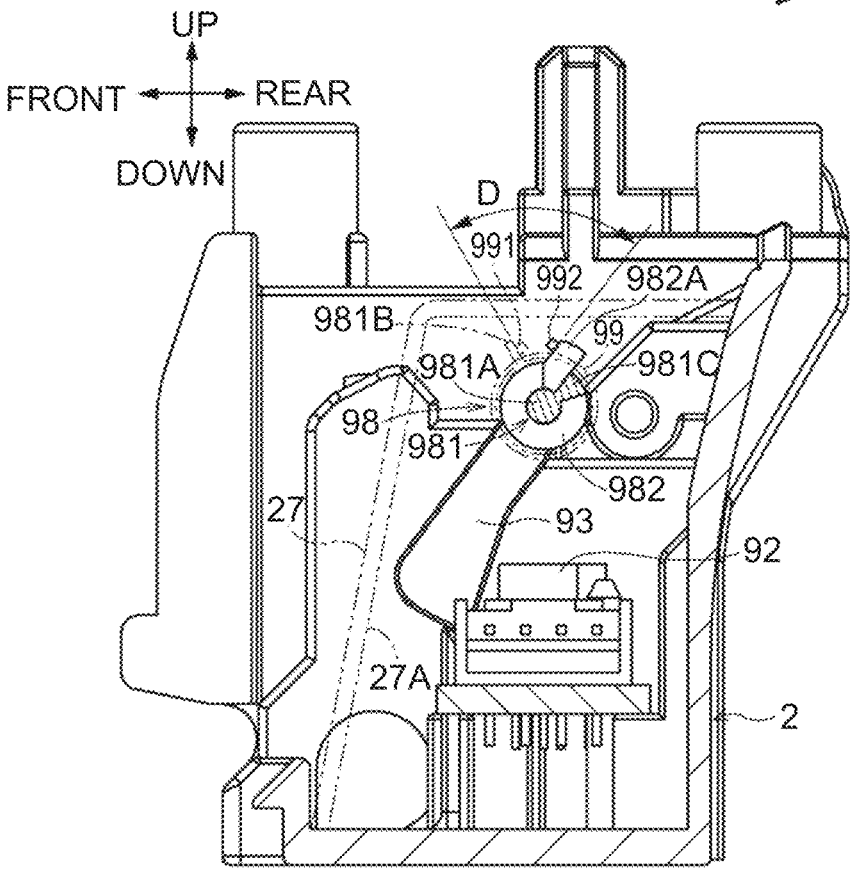
FIG. 12B is a cross-sectional view of the sheet detector, wherein a shield moves integrally with the contact element pivoting.

As the contact element 91 pivots from the initial state because some sheets are placed on the MP tray 21, the second connection 972 pivots about the first shaft 981 integrally with the first shaft 981, as illustrated in FIGS. 12A and 12B. As the first shaft 981 rotates, the second shaft 982 also rotates due to the urging force of the coil spring 99. The pivoting of the contact element 91 allows the first shaft 981 and the second shaft 982 to rotate integrally, thereby moving the shield 93 from the light shield position to the light transmission position.

Figure 13A:
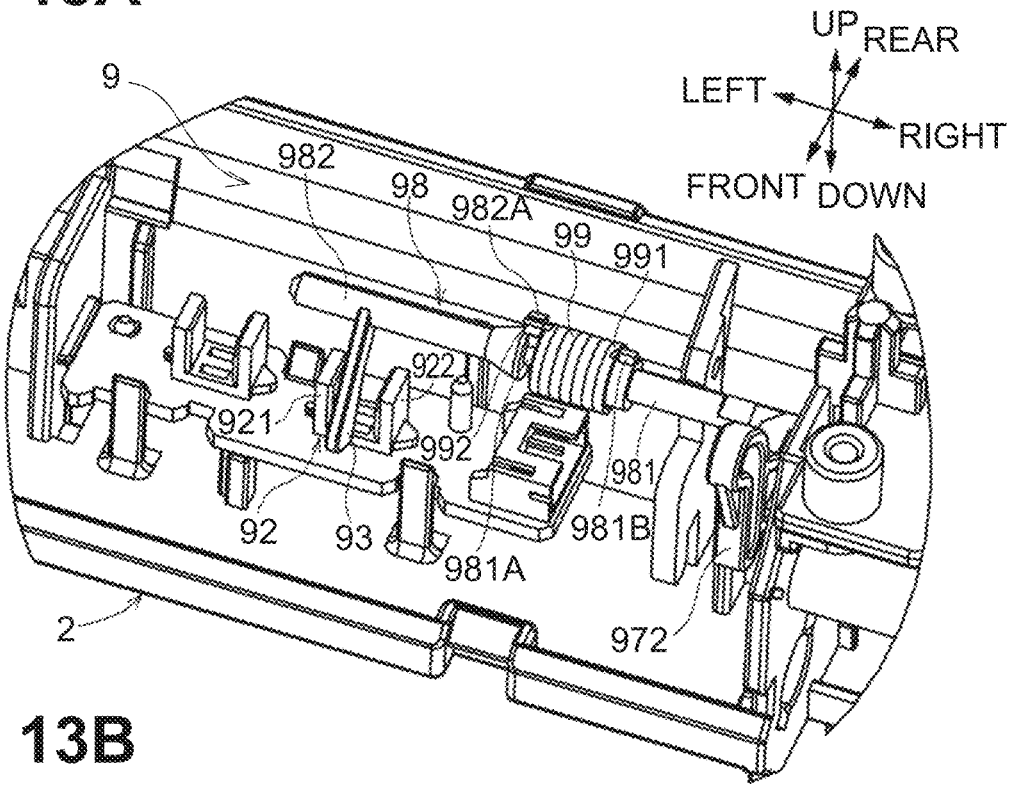
FIG. 13A is a perspective view of the sheet detector.
Figure 13B:
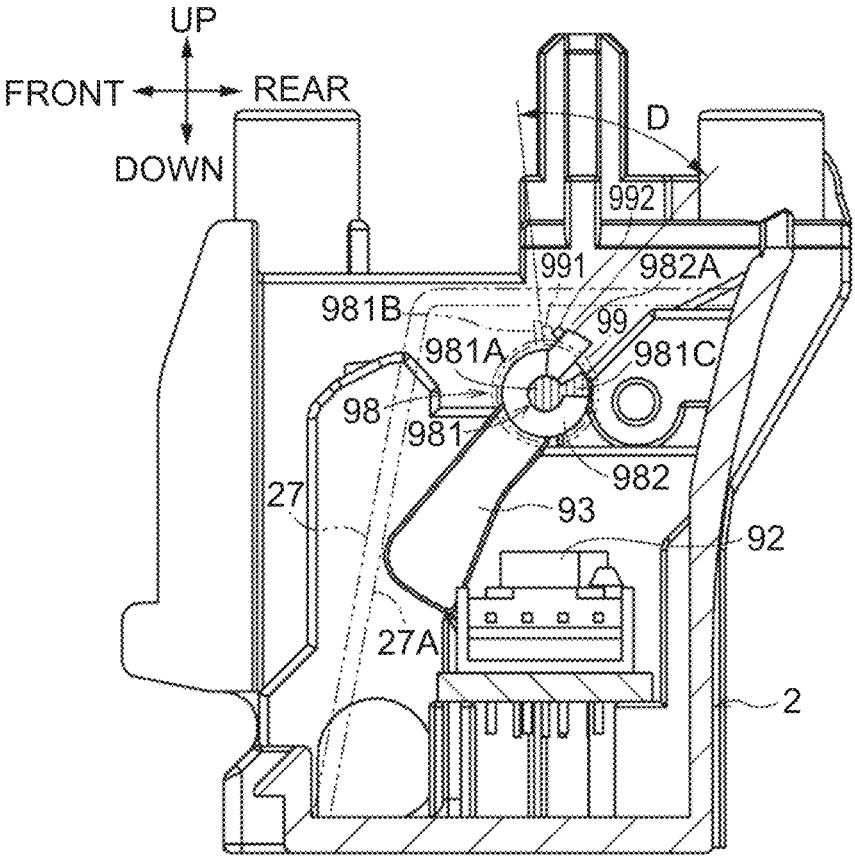
FIG. 13B is a cross-sectional view of the sheet detector, wherein the contact element pivots after the shield stops pivoting.

As the contact element 91 further pivots while the shield 93 is at the light transmission position, the shield 93 also pivots and contacts an inner surface 27A of the guide frame 27, as illustrated in FIG. 13B. When the shield 93 contacts the inner surface 27A of the guide frame 27, the shield 93 and the second shaft 982 are restricted from rotating any further and stop rotating.

In contrast, the contact element 91 and the first shaft 981 rotate against the urging force of the coil spring 99. The rotation of the contact element 91 and the first shaft 981 after the shield 93 and the second shaft 982 stop rotating causes the first engagement piece 981B to reach near the second engagement piece 982A in the circumferential direction, and reduces the angle D formed between the first engagement piece 981*b* and the second engagement piece 982A to be less than that illustrated in FIGS. 11B and 12B. Thus, the restriction piece 981*c* of the first shaft 981 moves away from the second engagement piece 982A of the second shaft 982.

The shield 93 stops moving during the pivoting of the contact element 91, thereby reducing the moving amount of the shield 93 according to the pivoting amount of the contact element 91. This also reduces the moving amount of the shield 93 in the guide frame 27, facilitating accommodation of the shield 93 inside the guide frame 27.

What is claimed is:

1. A sheet feeder comprising:

a sheet tray;

a feed roller configured to feed a sheet on the sheet tray;

a sheet feed frame that holds the feed roller;

a contact element pivotable relative to the sheet feed frame;

a guide frame disposed below the sheet feed frame;

a photosensor including a light emitter for emitting a light and a light receiver for receiving the emitted light;

a shield movable between a light transmission position and a light shield position; and a linkage connecting the contact element and the shield such that the shield is movable in association with pivoting of the contact element, wherein the light receiver receives the light emitted from the light emitter when the shield is at the light transmission position, wherein the shield at the light shield position shields the light receiver from the light emitted from the light emitter, wherein the contact element is pivotable in response to contacting with the sheet on the sheet tray, and wherein the linkage is configured to connect the contact element and the shield such that a first movement amount of the shield is less than a second movement amount of the shield, the first movement amount corresponding to the pivoting amount of the contact element in response to the number of sheets on the sheet tray changing from one to plural, the second movement amount corresponding to the pivoting amount of the contact element in response to the number of sheets on the sheet tray changing from zero to one.

2. The sheet feeder according to claim 1, wherein the photosensor is disposed in an internal space of the guide frame.

3. The sheet feeder according to claim 1, wherein the linkage comprises:

a first extension extending in a width direction from the contact element beyond a sheet feed range, the width direction being orthogonal to a sheet feed direction, the sheet feed range corresponding to a maximum size of a sheet supportable on the sheet tray;

a second extension extending in the width direction from the shield beyond the sheet feed range; and a connection connecting the first extension and the second extension outside the sheet feed range in the width direction.

4. The sheet feeder according to claim 3, wherein the connection comprises:

a first connection extending from the first extension toward the second extension;

a second connection extending from the second extension toward the first extension;

a boss located at one of the first connection or the second connection; and a slide groove located at one of the first connection or the second connection, and configured to receive the boss slidably.

5. The sheet feeder according to claim 4, wherein the boss is located at the first connection, wherein the slide groove is located at the second connection, wherein the boss is located closer to the shield than the contact element in the sheet feed direction, wherein the slide groove is closer to the contact element than the shield in the sheet feed direction, and wherein the slide groove comprises a first groove extending from a specific position toward the shield in the sheet feed direction, the specific position being a position at which the boss is located when the contact element does not contact with the sheet, and a second groove extending continuously from the first groove diagonally downward relative to the sheet feed direction.

6. The sheet feeder according to claim 3, wherein the second extension comprises:

a first shaft extending in the width direction and including a first engagement piece;

a second shaft extending in the width direction and including a second engagement piece; and a spring including a first engagement portion and a second engagement portion, the first engagement portion engaging with the first engagement piece, and the second engagement portion engaging with the second engagement piece, wherein the second shaft is configured to rotate, based on the urging force of the spring, in response to rotating of the first shaft, and wherein the shield is movable between a light transmission position and a light shield position in response to the rotation of the first shaft and the second shaft.

7. An image forming apparatus comprising the sheet feeder according to claim 1.

8. A sheet feeder comprising:

a sheet tray;

a feed roller configured to feed a sheet on the sheet tray;

a sheet feed frame that holds the feed roller;

a contact element pivotable relative to the sheet feed frame;

a guide frame disposed below the sheet feed frame;

a photosensor including a light emitter for emitting a light and a light receiver for receiving the emitted light;

a shield movable between a light transmission position and a light shield position; and a linkage connecting the contact element and the shield such that the shield is movable in association with pivoting of the contact element, wherein the light receiver receives the light emitted from the light emitter when the shield is at the light transmission position, wherein the shield at the light shield position shields the light receiver from the light emitted from the light emitter, wherein the contact element is pivotable in response to contacting with the sheet on the sheet tray, wherein the linkage is configured to connect the contact element and the shield such that a first movement amount of the shield is less than a second movement amount of the shield, the first movement amount corresponding to the pivoting amount of the contact element in response to the number of sheets on the sheet tray changing from one to plural, the second movement amount corresponding to the pivoting amount of the contact element in response to the number of sheets on the sheet tray changing from zero to one, wherein the linkage comprises a first extension extending in a width direction from the contact element beyond a sheet feed range, the width direction being orthogonal to a sheet feed direction, the sheet feed range corresponding to a maximum size of a sheet supportable on the sheet tray, a second extension extending in the width direction from the shield beyond the sheet feed range, and a connection connecting the first extension and the second extension outside the sheet feed range in the width direction, the connection comprising a first connection extending from the first extension toward the second extension and including a boss, and a second connection extending from the second extension toward the first extension and including a slide groove, the slide groove being configured to receive the boss slidably, the slide groove comprising a first groove extending from a specific position toward the shield in the sheet feed direction, the specific position being a position at which the boss is located when the contact element does not contact with the sheet, and a second groove extending continuously from the first groove diagonally downward relative to the sheet feed direction, wherein in response to the number of sheets on the sheet tray changing from zero to one, the boss moves from the first groove to the second groove, and wherein in response to the number of sheets on the sheet tray changing from one to plural, the boss moves along the second groove.

9. A sheet feeder comprising:

a sheet tray;

a feed roller configured to feed a sheet on the sheet tray;

a sheet feed frame that holds the feed roller;

a contact element pivotable relative to the sheet feed frame;

a photosensor including a light emitter for emitting a light and a light receiver for receiving the emitted light;

a shield for movable between a light shield position and a light transmission position; and a linkage including a first extension extending in a width direction and a second extension extending in the width direction, the contact element being connected at the end of the first extension, the shield being connected at the end of the second extension, and the width direction being orthogonal to a sheet feed direction, wherein the shield is located at the light shield position at which the shield is between the light emitter and the light receiver for shielding the light receiver from the emitted light while the contact element does not contact the sheet, wherein the contact element is configured to pivot in response to the contact element contacting the sheet, wherein the first extension is configured to pivot in response to the contact element pivoting, wherein the second extension is configured to pivot in response to the first extension pivoting, wherein the shield is configured to, in response to the second extension pivoting, move from the light shield position to the light transmission position at which the light receiver receives the emitted light, wherein the contact element is pivotable in response to contacting with the sheet on the sheet tray, and wherein the linkage is configured to connect the contact element and the shield such that a first movement amount of the shield is less than a second movement amount of the shield, the first movement amount corresponding to the pivoting amount of the contact element in response to the number of sheets on the sheet tray changing from one to plural, the second movement amount corresponding to the pivoting amount of the contact element in response to the number of sheets on the sheet tray changing from zero to one.

10. A sheet feeder comprising:

a sheet tray;

a feed roller configured to feed a sheet on the sheet tray;

a sheet feed frame that holds the feed roller;

a contact element pivotable relative to the sheet feed frame;

a guide frame disposed below the sheet feed frame;

a photosensor including a light emitter for emitting a light and a light receiver for receiving the emitted light;

a shield movable between a light transmission position and a light shield position; and a linkage connecting the contact element and the shield such that the shield is movable in association with pivoting of the contact element, the linkage comprising a first extension extending from the contact element beyond a sheet feed range, and a second extension extending from the shield beyond the sheet feed range, wherein the light receiver receives the light emitted from the light emitter when the shield is at the light transmission position, wherein the shield at the light shield position shields the light receiver from the light emitted from the light emitter, wherein the contact element is pivotable in response to contacting with the sheet on the sheet tray, and wherein the linkage is configured to connect the contact element and the shield such that a first movement amount of the shield is less than a second movement amount of the shield, the first movement amount corresponding to the pivoting amount of the contact element in response to the number of sheets on the sheet tray changing from one to plural, the second movement amount corresponding to the pivoting amount of the contact element in response to the number of sheets on the sheet tray changing from zero to one.

11. The sheet feeder according to claim 10, wherein the photosensor is disposed in an internal space of the guide frame.

12. The sheet feeder according to claim 10, wherein the width direction is orthogonal to a sheet feed direction, and the sheet feed range corresponds to a maximum size of a sheet supportable on the sheet tray; and wherein the linkage further comprises a connection connecting the first extension and the second extension outside the sheet feed range in the width direction, the connection comprising a first connection extending from the first extension toward the second extension, and a second connection extending from the second extension toward the first extension.

13. The sheet feeder according to claim 12, wherein the connection further comprises:

a boss located at one of the first connection or the second connection; and a slide groove located at one of the first connection or the second connection, and configured to receive the boss slidably.

14. The sheet feeder according to claim 13, wherein the boss is located at the first connection, wherein the slide groove is located at the second connection, wherein the boss is located closer to the shield than the contact element in the sheet feed direction, wherein the slide groove is closer to the contact element than the shield in the sheet feed direction, and wherein the slide groove comprises a first groove extending from a specific position toward the shield in the sheet feed direction, the specific position being a position at which the boss is located when the contact element does not contact with the sheet, and a second groove extending continuously from the first groove diagonally downward relative to the sheet feed direction.

15. The sheet feeder according to claim 12, wherein the second extension comprises:

a first shaft extending in the width direction and including a first engagement piece;

a second shaft extending in the width direction and including a second engagement piece; and a spring including a first engagement portion and a second engagement portion, the first engagement portion engaging with the first engagement piece, and the second engagement portion engaging with the second engagement piece, wherein the second shaft is configured to rotate, based on the urging force of the spring, in response to rotating of the first shaft, and wherein the shield is movable between a light transmission position and a light shield position in response to the rotation of the first shaft and the second shaft.

16. An image forming apparatus comprising the sheet feeder according to claim 10.

* * * * *